US006079068A

United States Patent [19]

Viard

[11] Patent Number: 6,079,068

[45] Date of Patent: Jun. 27, 2000

[54] METHOD AND APPARATUS FOR SUPPORTING AN ELEMENT TO BE SUPPORTED, IN PARTICULAR THE BODY OF A PATIENT, THE APPARATUS HAVING A SUPPORT DEVICE INDEPENDENT FROM THE CONTROL DEVICE

[75] Inventor: Jean-Louis Viard, Grabels, France

[73] Assignee: Support Systems International Industries, Montpellier Cedex, France

[21] Appl. No.: 08/995,669

[22] Filed: Dec. 22, 1997

[30] Foreign Application Priority Data

Dec. 23, 1996 [FR] France ..... 96 15849

[51] Int. Cl.[7] ..... A47C 27/08

[52] U.S. Cl. ..... 5/671; 5/672; 5/665; 5/713

[58] Field of Search ..... 5/665, 671, 672, 5/673, 676, 679, 685, 686, 687, 710, 713, 715, 738

[56] References Cited

U.S. PATENT DOCUMENTS

| | | | |
|---|---|---|---|
| 4,435,864 | 3/1984 | Callaway . | |
| 4,797,962 | 1/1989 | Goode | 5/713 |
| 4,833,457 | 5/1989 | Graebe, Jr. | 5/665 X |
| 4,873,737 | 10/1989 | Savenije | 5/710 X |
| 4,949,412 | 8/1990 | Goode | 5/713 |
| 5,020,176 | 6/1991 | Dotson | 5/672 X |
| 5,560,374 | 10/1996 | Viard . | |
| 5,850,644 | 12/1998 | Hsia | 5/672 X |
| 5,934,280 | 8/1999 | Viard et al. | 5/710 X |
| 6,009,580 | 1/2000 | Caminade et al. | 5/710 X |

FOREIGN PATENT DOCUMENTS

| | | |
|---|---|---|
| 0 218 301 | 4/1987 | European Pat. Off. . |
| 0 676 158 | 10/1995 | European Pat. Off. . |
| 94 11 493 | 11/1994 | Germany . |

*Primary Examiner*—Michael F. Trettel
*Assistant Examiner*—Robert G. Santos
*Attorney, Agent, or Firm*—Wolf, Greenfield & Sacks, P.C.

[57] ABSTRACT

The invention relates to a method and apparatus for supporting an element to be supported, in particular the body of a patient. The apparatus comprises a support device 20 essentially comprising only at least one closed or controlled-release chamber 21 together with inlet and outlet means 26 via which the filling fluid can be fed in or removed, and an independent control device 40 is provided disposed under the support device 20, said control device 40 comprising filling and emptying means for filling the chamber with filling fluid or for emptying said fluid therefrom and the control means proper 50, 41, 42 for controlling feeding in and removing the filling fluid. The invention makes it possible to simplify manufacture and management of a support for supporting an element to be supported such as the body of a patient.

19 Claims, 1 Drawing Sheet

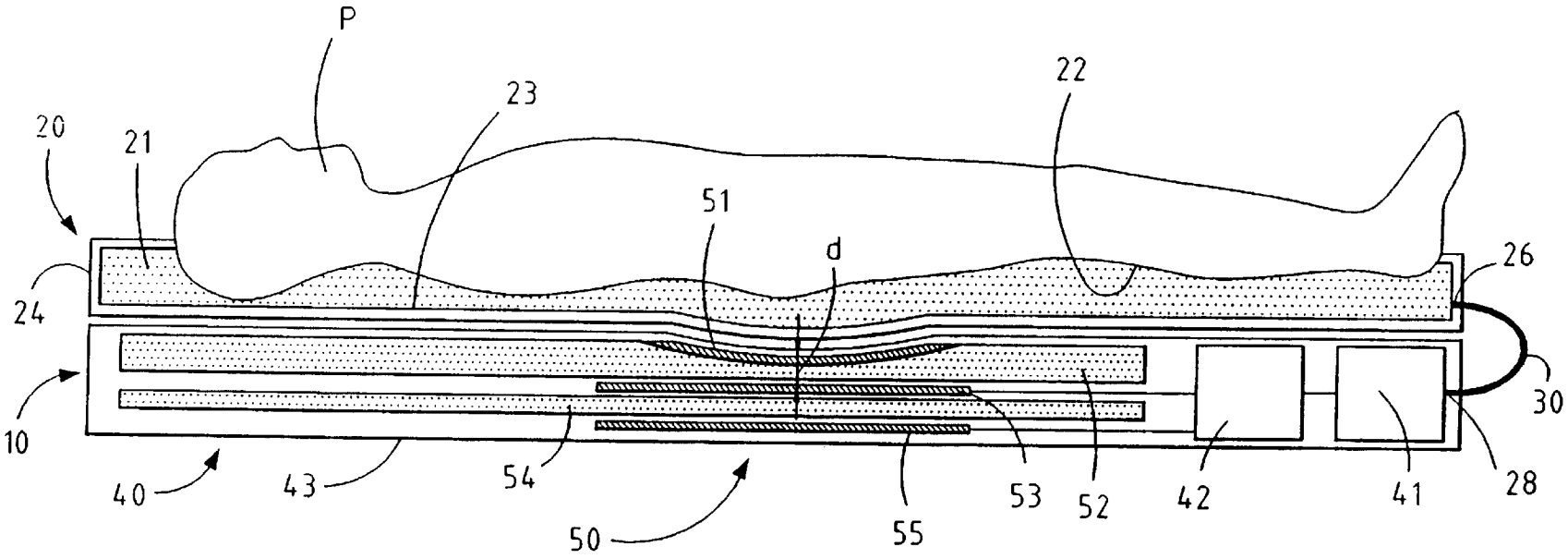
20
21
P
23
22
24
10
40
43
50
51
54
d
55
53
52
42
41
26
28
30

METHOD AND APPARATUS FOR SUPPORTING AN ELEMENT TO BE SUPPORTED, IN PARTICULAR THE BODY OF A PATIENT, THE APPARATUS HAVING A SUPPORT DEVICE INDEPENDENT FROM THE CONTROL DEVICE

The invention relates to a method and apparatus or supporting an element to be supported, in particular the body of a patient, the apparatus having support device proper and a monitoring or control device that is independent from and physically separate from the support device. The invention may be particularly advantageously applied to preventing and treating complications related to long periods of being confined to bed and of being kept still, in particular bedsores.

BACKGROUND OF THE INVENTION

The prior art, and in particular the Applicant's prior document FR-A-2 718 347=EP-A-676 158, which also issued as U.S. Pat. No. 5,560,374 to Viard discloses a method and a device for supporting an element to be supported, in particular the body of a patient, making it possible to support the element at an essentially constant controlled penetration depth.

In the Applicant's prior document, a measurement device is provided comprising a first element that is integrated in the support device, which complicates the manufacturing technology and exposes the integrated element to any damage that is inflicted to the support element itself.

Furthermore, the monitoring or control means are disposed externally which increases the overall size of the device, and gives rise to coupling and installation difficulties.

In addition, that prior device suffers from the drawback that technical elements are integrated with the therapeutic surface, which increases the difficulty of managing the therapeutic surface, in particular as regards interchangeability.

To reduce the overall size and to simplify implementation and management, it has been proposed, in Document US-A-5,325,551 to integrate the monitoring and control devices inside the mattress unit itself.

Unfortunately, that solution does not solve the problem of making the technical elements independent from the mattress unit, this problem being addressed for the first time by the inventors.

OBJECTS AND SUMMARY OF THE INVENTION

The present invention makes it possible to dissociate fully the monitoring and control means from the support means, and in particular from the mattress constituting the therapeutic prevention and treatment surface when the body of a patient is to be supported.

The present invention makes it also possible to simplify the manufacturing technology of the support element, in particular of a mattress when the body of a patient is to be supported, and to make it independent from the monitoring or control technology for monitoring or controlling the support element, while retaining a structure that is simple with as few connections as possible, and in particular by making it impossible for such connections to be accidentally accessible or damageable.

The present invention makes it easy to replace the support element, in particular a mattress, when it is damaged or contaminated, without significantly affecting the monitoring and/or control means.

All of these technical problems are solved for the first time by the present invention in a manner that is simple, cheap, safe, and reliable, that is easy to implement, and that can be used industrially and medically.

Thus, in a first aspect, the present invention provides a method of supporting an element to be supported, in particular the body of a patient, the method consisting in providing at least one support device comprising at least one closed or controlled-release flexible chamber, in providing filling and emptying means for filling said chamber with a filling fluid and emptying said fluid from said chamber, and in providing control means for controlling the filling and emptying means, wherein said support device essentially comprises only said at least one closed or controlled-release chamber, together with inlet and outlet means via which said filling fluid can be fed in or removed, and wherein an independent control device is provided disposed under the support device, said control device comprising the filling and emptying means for filling the chamber with the filling fluid or for emptying said fluid therefrom, together with the control means proper for controlling feeding in or removing the filling fluid.

In an advantageous implementation, the independent control device further comprises measurement means for measuring the penetration distance to which the element to be supported penetrates into the chamber of the support device, the independent control means comprising servo-control means for servo-controlling the filling and emptying means present in said independent control device so as to servo-control feeding the filling fluid into said chamber of the support element and removing said fluid therefrom at least as a function of the measured penetration distance.

In another implementation, the measurement device present in the independent control device delivers information mirroring the extent to which the element to be supported penetrates into the support device, and it comprises a metal film associated with a spacer element of thickness that is predetermined and compressible as a function of the penetration distance to which the element to be supported penetrates into the chamber of the support device, said metal film co-operating with an impedance-varying element whose position is fixed and substantially opposite from said metal film, in particular under the bottom surface of the spacer element of variable thickness, an electric signal thus being generated as a function of the penetration distance to which the element to be supported penetrates into the support device, which signal is transmitted to the control system.

In another implementation, the spacer element of variable thickness is itself disposed on a spacer element of fixed thickness.

In another implementation of the invention, a shielding element, in particular a shielding induction coil, is provided disposed on that face of the spacer element of fixed thickness which is further from the above-mentioned impedance-varying element interposed between the spacer element of variable thickness and said spacer element of fixed thickness.

In a particularly advantageous other implementation of the invention, the above-mentioned support device is incorporated in an individual cover, the independent control device itself being incorporated in a second independent individual cover, the support device and the independent control device comprising coupling means enabling the control device to cause the filling fluid to be fed into the chamber of the support device or to be removed therefrom.

In another implementation of the invention, the control device takes up an area that is not larger than the area serving to receive the support device.

In another implementation of the invention, the element to be supported is constituted by the body of a patient, and the support element is constituted by a mattress comprising one or more closed or controlled-release flexible chambers as mentioned above, said mattress constituting the prevention or treatment surface, and the independent control device comprising all of the monitoring means and all of the control means for monitoring and controlling the therapeutic surface.

In a second aspect, the present invention relates to apparatus for supporting an element to be supported, in particular the body of a patient, the apparatus comprising: at least one support device comprising at least one closed or controlled-release flexible chamber; inlet and outlet means via which a filling fluid can be fed into said chamber or removed therefrom; and control means for controlling the filling and emptying means; wherein the support device essentially comprises only said at least one closed or controlled-release chamber, the support apparatus further comprising an independent control device disposed under the support device, said control device comprising the filling and emptying means for filling the chamber with the filling fluid or for emptying said fluid therefrom together with the control means proper for controlling feeding in and removing the filling fluid.

Various advantageous embodiments of the apparatus result clearly from the advantageous implementations of the method described above, and they may also result from the following description taken as a whole and incorporating the drawing.

It can thus be understood that the present invention makes it possible to solve the above-mentioned new technical problem well. In the context of the invention, when the support element is damaged or contaminated, such a support element being in particular a mattress, which is conventional when supporting patients confined to bed or kept still for prolonged periods of time, and in particular when treating such patients, the invention makes ideal interchangeability possible because the support element or the mattress is independent, of construction that is simple and cheap, and it contains no technical element. Furthermore, the support element, in particular a mattress, serves as a sort of protective surface for protecting the independent control device which is itself also protected by an individual protective cover.

It can thus be understood that the invention offers a decisive technical improvement making it possible to lower the manufacturing cost and above all the operating cost, this being a major concern when managing equipment, in particular in hospitals. Furthermore, the invention is very versatile because it can be adapted to suit any support device structure, in particular a mattress, and especially a mattress having a single chamber or a mattress having multiple chambers regardless of whether the chambers communicate with one another, and to suit surfaces whose operating modes are different, in particular single-chamber or multi-chamber support surfaces having continuous operating modes, and surfaces having modes involving alternating pressures, or rotating, pulsating, or percussive pressures, without this being limiting.

Other objects, characteristics, and advantages of the invention appear clearly on reading the following explanatory description made with reference to a currently-preferred embodiment of the invention given merely by way of illustration, and therefore in no way limiting the scope of the invention. It should be noted that any characteristic that appears to be novel compared with any prior art on the basis of the description taken as a whole and incorporating the drawing is an integral part of the present invention and of the present description.

BRIEF DESCRIPTION OF THE DRAWING

In the drawing, the sole FIG. 1 is a longitudinal section view through support apparatus of the present invention comprising a support device itself comprising a support device proper and an independent control device in a currently-preferred embodiment of the present invention.

MORE DETAILED DESCRIPTION

The sole FIGURE shows apparatus of the invention under the overall reference 10. This support apparatus 10 comprises a support device proper given overall reference 20 and comprising at least one closed or controlled-release flexible chamber 21 and having a top face 22 and a bottom face 23, said chamber being enclosed in an individual protective cover 24. The chamber 21 is provided with interconnection means 26 connected by connector means given overall reference 30 to corresponding interconnection means 28 integrated in an independent control device that is given overall reference 40 and that is described below.

The independent control device 40 is advantageously provided with an individual protective cover 43 containing the monitoring and control members 50, 41, and 42 that are described below.

In a currently-preferred embodiment, the monitoring member 50 comprises measurement means for measuring information mirroring the extent to which an element to be supported, in particular the body of a patient P, penetrates into the chamber 21 of the support device 20. The measurement means advantageously comprise a metal film 51 associated, in this example, with the top surface of a spacer element 52 of variable thickness reacting to the penetration of the body of the patient P into the chamber 21 of the support element 20, and co-operating with an impedance-varying element 53 disposed under the opposite surface of the spacer element 52 of variable thickness. In the embodiment shown, the impedance-varying element 53 is itself disposed on the top face of a spacing element 54 of fixed thickness. In the preferred embodiment shown in the accompanying sole FIGURE, the opposite face of the spacing element 54 of fixed thickness is provided with a shielding element, preferably constituted by a shielding induction coil 55 disposed at a predetermined distance from the measurement element 53, which is achieved by the presence of the rigid spacing element 54, so as to prevent any influence from a metal mass situated under the measurement device or in the vicinity thereof, which is generally the case at least for the frame of the apparatus.

The impedance-varying element 53 and the shielding element 55 are electrically connected to a control station 42 which drives the means 41 for filling the chamber 21 of the support device with filling fluid or for emptying said fluid from said chamber.

The spacer element 52 of variable thickness may be implemented in various ways. It may merely be a bladder that can be inflated with a fluid such as air or water, or it may be an element made of compressible foam of suitable density. Other variant embodiments of the spacer element 52 of variable thickness can naturally be implemented by a person skilled in the art.

The control member 50, 41, 42 naturally comprises the filling means and emptying means proper for filling the chamber 21 of the support element 20 with filling fluid and for emptying said fluid from said chamber. Such filling means and emptying means are well known to a person skilled in the art, the filling means comprising, for example, pumping means such as an air or water pump or turbine, and the emptying means generally comprising a valve connected to the atmosphere and controlled selectively by the control station 42.

It can be understood that construction, operation, and management of the apparatus are particularly simple as a result of the simplified and interchangeable design of the support element (preferably a mattress for supporting a patient) which can be changed very simply merely by disconnecting the filling or emptying connections 30, and this simplicity also applies to the independent control device. When the control device breaks down, it is also possible to replace it without having to remove the patient from the support element (in particular a mattress).

It can thus be understood that the invention makes it possible to achieve decisive technical improvements reducing the manufacturing and operating costs.

The invention also covers any means constituting technical equivalents of the means described, and the various combinations thereof. Furthermore, the sole FIGURE is an integral part of the present invention, and thus of the present description.

What is claimed is:

1. A method of supporting a body element, comprising:

providing at least one support device comprising at least one closed or controlled-release flexible chamber located between a top face for receiving the body element and a bottom face;

providing inlet and outlet means via which a filling fluid can be fed into said chamber or removed therefrom, providing a control device, separate and independent from said at least one support device, comprising a flexible wall disposed in contact under said bottom face of said at least one support device and including a control member arranged to regulate filling and emptying means for filling said at least one flexible chamber with said filling fluid or for emptying said fluid therefrom, penetrating said at least one flexible chamber by said body element and thereby partially changing a shape of said flexible wall of the control device, measuring a penetration distance into said at least one support device by detecting said partial shape change of said control device and providing said partial shape change to said control member, and filling and emptying said at least one chamber with said filling fluid by said filling and emptying means, respectively, based on regulation from said control member.

2. The method of claim 1, wherein said filling and emptying is performed by coupling means enabling the control member to cause the filling fluid to be fed into the chamber of the support device or to be removed therefrom.

3. The method of claim 1, wherein said penetrating said at least one chamber by said body element includes horizontally positioning a patient on said top face constituting a prevention or treatment surface.

4. A method of supporting a body element comprising:

providing at least one support device comprising at least one closed or controlled-release flexible chamber;

providing inlet and outlet means via which a filling fluid can be fed into said chamber or removed therefrom;

providing a control device, separate and independent from-said at least one support device, disposed in contact under said at least one support device and including a control member arranged to regulate filling and emptying means for filling said at least one flexible chamber with said filling fluid or for emptying said fluid therefrom;

penetrating said at least one flexible chamber by said body element and thereby partially changing a shape of said at least one control device;

measuring a penetration distance into said at least one support device by detecting said partial shape change of said control device, performing said detection by a monitoring member and providing said penetration distance to said control member; and filling and emptying said at least one chamber with said filling fluid by said filling and emptying means operatively connected to servo-controlled means, respectively, based on regulation from said control member in communication with said monitoring member, said filling and emptying being performed at least as a function of the measured penetration distance, wherein said measuring by the monitoring member includes providing a metal film, associated with a variable thickness spacer element including a top surface and a bottom surface, and an impedance-varying element whose position is fixed, substantially opposite from said metal film, in particular under the bottom surface of the variable thickness spacer element; and generating an electric signal as a function of the penetration distance.

5. The method of claim 4, wherein said measuring includes shielding any influence from a metal mass situated in the vicinity of the monitoring member by providing a shielding element disposed on said bottom face of a fixed thickness spacer element opposite with respect to the impedance-varying element interposed between the variable thickness spacer element and said fixed thickness spacer element.

6. An apparatus for supporting a body element, comprising:

a support device including at least one closed or controlled-released flexible chamber located between a top face for receiving the body element and a bottom face;

a control device, separate and independent from said at least one support device, comprising a flexible wall disposed under said bottom face of said at least one support device, and including a control member, a pump device and a monitoring member and;

an inlet and an outlet operatively connected to said pump device and constructed to fill or remove a filling fluid from said at least one flexible chamber;

said control device including said flexible wall constructed and arranged to be located below said bottom face in contact with said support device in a way that penetration of said body element into said support device creates a shape change of said flexible wall of the control device;

said monitoring member being constructed and arranged to measure a penetration distance of said body element into said support device by measuring said shape change of said flexible wall of the control member and provide said penetration distance to said control member; and said control member being constructed and arranged to control said pump device to fill and empty said at least one chamber with said filling fluid based on said penetration distance.

7. The apparatus of claim 6, wherein said control device further includes a servo-controller constructed and arranged to control said pump device based upon control information from said control member.

8. The apparatus of claim 6, wherein said monitoring member includes a metal film and an impedance-varying element.

9. The apparatus of claim 6, wherein said support device includes a mattress.

10. The apparatus of claim 6, further including a cover at least partially enclosing said support device.

11. The apparatus of claim 6, wherein said bottom face of said support device has a substantially similar size as a top surface of said control device, and wherein said bottom surface of said support device is in contact substantially over its entire area with said top surface of said control device.

12. The apparatus of claim 6, wherein a top surface of said control device has a size not larger than a size of said bottom face of said support device, and wherein said top surface of said control device is in contact substantially over its entire area with said bottom surface of said support device.

13. The apparatus of claim 6, wherein said separate and independent control device is included in a flexible cover.

14. The apparatus of claim 6, wherein said control device includes a variable thickness spacer, including a top and a bottom surface and being compressible, arranged to substantially undergo said shape change, and wherein said monitoring device includes a metal film and an impedance-varying element, said metal film being disposed at said top surface of said variable thickness spacer and said impedance-varying element being disposed at said bottom surface of said variable thickness spacer.

15. An apparatus for supporting a body element, comprising:

a support device including at least one closed or controlled-released flexible chamber;

a control device, separated and independent from said at least one support device, including a control member, a pump device and a monitoring member;

an inlet and an outlet operatively connected to said pump device and constructed to-fill or remove a filling fluid from said at least one flexible chamber;

said control device being constructed and arranged to be located in contact with said support device in a way that penetration of body element into said support device creates a shape change of said control device;

said monitoring member being constructed and arranged to measure a penetration distance of said body element into said support device by measuring said shape change of said control device and provide said penetration distance to said control member; and said control member being, constructed and arranged to control said pump device to fill and empty said at-least one chamber with said filling fluid based on said penetration distance; wherein said control member includes a variable thickness spacer, including a top surface and the bottom surface and being compressible, arranged to substantially undergo said shape change, and wherein said monitoring member includes a metal film and an impedance-varying element, said metal film being disposed at said top surface of said variable thickness spacer and said impedance-varying element being disposed at said bottom surface of said variable thickness spacer.

16. The apparatus of claim 15, wherein said impedance-varying element includes a coil.

17. The apparatus of claim 15 further including a shielding element constructed and arranged to substantially eliminate any influence from a metal mass situated in the vicinity of said monitoring member.

18. The apparatus of claim 15, wherein said shielding element includes an induction coil.

19. The apparatus of claim 17 further including a fixed thickness spacer including a top surface and a bottom surface, said impedance-varying element being disposed at said top surface of said fixed thickness spacer and said shielding element being disposed at said bottom surface of said fixed thickness spacer.

* * * * *